US005709589A

United States Patent [19]

Boone

[11] Patent Number: 5,709,589

[45] Date of Patent: Jan. 20, 1998

[54] HARDWOOD FLOOR FINISHING PROCESS

[76] Inventor: Charles Daniel Boone, 1046 Plainfield Ave., Orange Park, Fla. 32073

[21] Appl. No.: 623,885

[22] Filed: Mar. 29, 1996

[51] Int. Cl.[6] ..... B24B 1/00

[52] U.S. Cl. ..... 451/54; 451/59; 451/353; 451/531

[58] Field of Search ..... 451/28, 54, 57, 451/350, 353, 530, 548, 59

[56] References Cited

U.S. PATENT DOCUMENTS

| | | | |
|---|---|---|---|
| 4,169,005 | 9/1979 | Fogle et al. | 156/272.2 |
| 4,768,311 | 9/1988 | Olson | 451/59 |
| 5,129,708 | 7/1992 | Swan | 451/353 X |
| 5,454,751 | 10/1995 | Wiand | 451/353 X |
| 5,567,503 | 10/1996 | Sexton et al. | 451/353 X |

*Primary Examiner*—Timothy V. Eley
*Attorney, Agent, or Firm*—Arthur G. Yeager

[57] ABSTRACT

The process which adds to the prior art steps of scraping, screening, and sanding the floor and applying a coat of a water-base sealer; the improvement steps of hand rubbing with fine sandpaper to remove all high spots and raised grain; subjecting the floor to the action of a rotating buffing pad having a diametric strip of sandpaper adhered thereto, followed by buffing with a rotating buffer pad unmodified with a strip of sandpaper; removing all dust by vacuuming and wiping with an aqueous dampened cloth; applying a coat of water-base finish; and repeating the above improvement steps with increasing fine sandpaper at least twice more to produce the final finished wood floor.

11 Claims, No Drawings

HARDWOOD FLOOR FINISHING PROCESS

TECHNICAL FIELD

This invention relates to the technology of finishing hard wood floors of all types, with a water-base finish in such a manner as to eliminate future development of raised grain.

BACKGROUND OF THE INVENTION

Hardwood floors have been employed in quality housing and offices for more than 150 years. In order to make the surface of the flooring hard so as to withstand wear and tear, and also so as to make it beautiful in appearance, the raw wood has been treated to smoothing steps and finishing steps. These include sanding, scraping, screening to smooth the surface. The finishing has included steps of applying sealants, varnishes, stains, shellacs, and waxes to provide the desired appearance. Today there are machines which will do some of these tasks, e.g. sanding machines to drive a belt of sandpaper which abrades the floor; to drive a circular disc of sandpaper, or to drive an oscillating rectangle of sandpaper. Buffing machines are made to provide the same basic motions to a pad of stiff fibers which function to abrade the surface more gently than sandpaper, and somewhat akin to fine steel wool. The application of a finish may be by paint brush, lambs wool applicator, or by rolling. A typical combination of these operations in the order performed might be; 1.) to hand scrape or rough sand a raw wood floor; 2.) to sand by machine with a medium grit sandpaper; 3.) to sand by hand with a fine grit sandpaper; 4.) to remove all dust; 5.) to apply a coat of sealant and allow it to dry; 6.) to abrade the surface with fine grit sandpaper or steel wool; 7.) to remove all dust; and 8.) to apply a coat of varnish or shellac.

It has now been discovered that if the above procedure is modified, a very high quality finish on the flooring can be produced. The modification involves the use of a finish that is an aqueous dispersion of a urethane polymer and an acrylic polymer preceded by smoothing the floor with a rotating buffing pad having a strip of fine grit sandpaper adhered to the buffing pad in a diametric direction, followed by buffing without the sandpaper being present, and then cleaning the floor of all dust by vacuuming and by wiping with an aqueous dampened rag.

It is an object of this invention to provide a novel finishing process for a hardwood floor. It is another object of this invention to provide such a process employing repeated steps of sanding, buffing, dust removal, and application of a coat of water-base finish. Still other objects will appear from the more detailed description which follows.

BRIEF SUMMARY OF THE INVENTION

This invention relates to a process for finishing hardwood flooring with abrasive materials down to about 100 mesh in size followed by the application of a water-base sealer to produce a finished flooring; the improvement which comprises hand rubbing around the perimeter of the finished flooring with 120–150 grit sandpaper at all places of roughness and raised grain; applying to the sanded flooring a rotating buffing pad having adhered to the buffing face thereof a diametric strip of sandpaper of 120–150 grit the width of said strip being about 15–25% of the diameter of said pad; buffing the floor with a buffing pad unmodified with sandpaper, and vacuuming the buffed surface to remove all dust; applying to the floor surface a coat of water-base finish and allowing it to dry; applying to the finished, dried flooring a rotating buffing pad having adhered to the buffing face thereof a diametric strip of screen of 150–180 mesh grit said strip having a width of about 15–25% of the diameter of said buffing pad; and buffing the flooring a second time and applying another coat of a water-based finish.

In a specific and preferred embodiment of the invention the finish is an aqueous dispersion of a urethane polymer or acrylic polymer, and a crosslinking agent. In another embodiment the steps of buffing the floor with a buffing pad unmodified with sandpaper; vacuuming the buffed surface to remove all dust and applying to the floor surface a coat of a water-base finish and allowing it to dry are repeated twice. In another specific and preferred embodiment the steps above are repeated twice so as to apply four coats of water-base finish. In still another specific and preferred embodiment the buffing is accomplished by a rotating pad of stiff fibers felted into a circular pad 0.25-0.50 thick.

DETAILED DESCRIPTION OF THE INVENTION

This invention is a modification and extension of basic steps for preparing and finishing hardwood flooring, a principal difficulty of which being the absorption of moisture causing the grain to swell and raise, producing a roughness of the floor surface.

Generally it has been standard practice in the past to lay a hardwood floor; sand, scrape, and/or screen the raw wood floor; clean the floor and apply a sealant; followed by a coat or two of varnish. This treatment has not been sufficient to prevent subsequent grain raising.

The present invention modifies and extends this process to produce an excellent finish that is resistant to eliminate grain raise. The modification includes three or repeated series of steps. Each series of steps includes (1) a combination of buffing and sanding, (2) buffing, (3) cleaning to remove all dust, and (4) applying a coat of a water-base finish which is an aqueous dispersion of a urethane polymer, an acrylic polymer, and a crosslinking agent.

The present invention preferably begins after the application of a sealant and before applying the final coats of water base finishes, shellac or the like. As described above the first steps of preparing the floor for application of a sealant include sanding, scraping, screening the flooring with abrasive materials down to about 100 mesh in size, and cleaning to produce a smooth surface, followed by brushing or application of a sealant, and allowing it to dry completely. Then the steps of this process are undertaken.

First, The dried sealed floor is hand-rubbed with fine grit sandpaper (120–150 grit) around all edges and corners and door jambs. Any grain rise is removed. Second, a buffing machine is used with a buffing pad having a diametric strip of fine grit sandpaper (120–150 grit) about 3–4 inches wide on a buffing pad 12–18 inches in diameter. The floor is completely buffed with such a combination. Third, buffing the entire floor with a buffing pad (12–18 inches in diameter) and made of stiffened fiber fitted into a pad. Fourth, the entire floor is carefully cleaned with a vacuum cleaner followed by use of a tack rag to pick up dust. The tack rag is a textile cloth dampened with an appropriate nonaqueous liquid. Fifthly and lastly, the floor is covered with a first coat of a water-base finish of a polyurethane and a suitable crosslinking agent; and allowing the finish to dry completely.

These steps (first-fifth above may be repeated as many times as desired to produce a high quality finished floor. Generally it is preferred that two or three series of these steps are employed. Each succeeding series of steps involves the same operations as given above, although preferably each series uses finer grit sandpaper than used in the preceding series. Thus, if sandpaper of 120–150 grit were used in the first series, it would be appropriate to use sandpaper of 150–180 grit in the second series, and sandpaper of 180–200 grit in the third series. If different grades of buffing pads are employed, they also should be finer and finer in the second and third series of steps.

Buffing is accomplished by a prior art machine to which a buffer pad is attached and the machine is moved across the floor as is a prior art sanding machine. Normally the pad rotates counterclockwise as seen by the operator looking down from above the pad. Buffing usually begins by buffing around the perimeter of the room, moving to the left. After outlining the room, the floor is buffed by starting in the right corner and moving left across the room, keeping the buffer ahead and to the left of the body of the operator and angling the handle backwards. The second sweep of buffing moves to the right over the same row area covered on the first sweep angling the handle upwards, except this one is to the right, and the third sweep starts a new row, which is one-half of the diameter of the buffer pad, to the left, etc. overlapping rows so as to buff completely over the floor.

There is nothing critical about the sandpaper, except it must be of the non-loading or open-coat type where dust or finish does not bond or load-up on the sandpaper and so long as the grit size is appropriate.

The buffing pads are commercially available felted pads of stiffened fibers. The pads are 0.25–0.50 inch thick, preferably about 0.375.

The finish is not critical, although some appear to be preferred over others. The preferred type is a dispersion of urethane and acrylic polymer dispersion in water in the presence of a crosslinking agent which chemically ties polymer chains together, such as commercially available polyfunctional aziridine crosslinker sold by Bonakemi USA, Inc. These are prior art materials and can be purchased in the open market.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a process for finishing hardwood flooring including sanding, scraping, and screening the flooring with abrasive materials down to about 100 mesh in size followed by the application of a water-based sealer to produce a pre-finished flooring having places of roughness and raised grain; the improvement which comprises:

(a) hand rubbing the pre-finished flooring with 120–150 grit sandpaper at all places of roughness and raised grain and removing all debris produced in this step;

(b) simultaneously buffing and sanding the flooring of step (a) with a rotating substantially circular buffing pad having adhered to a planar buffing face thereof a general diametric strip being about 10–25% of the diameter of the pad and removing all debris produced in this step;

(c) buffing the flooring of step (b) with a buffing pad unmodified with sandpaper, and vacuuming the buffed flooring to remove substantially all debris and dust produced in this step;

(d) applying to the buffed flooring of step (c) a coat of a water-based finish and allowing it to dry;

(e) hand rubbing the dried flooring of step (d) with 150–180 grit sandpaper at all places of roughness and raised grain;

(f) applying to the flooring of step (e) a rotating buffing pad having adhered to the buffing face thereof a diametric strip of non-loading sandpaper of 150–180 grit the width of the strip being about 10–25% of the diameter of the pad; and (g) repeat steps (c) and (d) to the flooring of step (f).

2. The process of claim 1 which additionally comprises wiping the entire flooring with an aqueous dampened tac rag to remove all of the fine dust remaining after vacuuming and prior to each step (d).

3. The process of claim 1 which additionally comprises a second series of steps (b), (c), (d), and (e) wherein the strip of non-loading sandpaper of the second step (b) has a grit of 150, the second series commencing after step (b) and before steps (e) and (f).

4. The process of claim 3 which additionally comprises wiping the entire flooring with an aqueous dampened tac rag to remove all of the fine dust remaining after vacuuming and prior to each step (d).

5. The process of claim 3 which additionally comprises a third series of steps (b), (c) and (d) wherein the strip of non-loading sandpaper of the third step (b) has a grit of 180, the third series commencing after the second series of steps.

6. The process of claim 5 which additionally comprises wiping the entire flooring with an aqueous dampened tac rag to remove all of the fine dust remaining after vacuuming and prior to each of steps (d).

7. The process of claim 1 wherein the buffing of step (c) is accomplished by using another planar face of the same pad used in step (b).

8. The process of claim 1 wherein the water-based finish is a urethane and acrylic polymer dispersion in water.

9. A process for providing a smooth high quality finish to hardwood flooring which comprises sanding, scraping, and screening to produce a dust-free smooth floor surface to which has been applied a water-based sealer that has dried between two and twenty-four hours dependent primarily on humidity conditions and temperature to produce a pre-sealed floor;

(a) hand rubbing with sandpaper the pre-sealed floor at all locations where roughness is present to produce an even, smooth, pre-sealed floor;

(b) simultaneously buffing and sanding the even, smooth, pre-sealed floor with a rotating substantially circular buffer pad having adhered to it a generally diametric strip of non-loading sandpaper of 120–150 grit, the strip having a width of 10–25% of the diameter of the pad;

(c) removing all debris produced by steps (a) and (b) followed by buffing the floor with an unmodified, rotating buffer pad;

(d) removing all dust produced by step (c) from the floor by vacuuming and wiping with an aqueous dampened rag;

(e) applying to the floor a first coat of a water-based finish, and allowing it to dry to a first finish;

(f) repeating step (a);

(g) subjecting the first finish to the action of a rotating substantially circular buffer pad having adhered to it a general diametric strip of non-loading sandpaper of 150–180 grit, the strip having a width of 10–25% of the diameter of the pad;

(h) remove all debris followed by buffing the floor with an unmodified rotating buffer pad;

(i) removing all dust produced by steps (g) and (h) therefrom by vacuuming and wiping with an aqueous dampened rag; and (j) applying to the floor a second coat of a water-based finish and allowing it to dry to a second finish.

10. The process of claim 9 which additionally comprises repeating steps (a), (b), (c), and (d) before step (f) and using non-loading sandpaper of 150 grit in repeated step (b) and; applying to the floor an intermediate coat of a water-based finish and allowing it to dry to an intermediate finish.

11. The process of claim 10 which additionally comprises further repeating of steps (a), (b), (c), and (d) after repeated step (d) and using non-loading sandpaper of 180 grit in further repeated step (b); and applying to the floor a further coat of a water-based finish and allowing it to dry to a further finish.

* * * * *